US009718083B2

(12) United States Patent
Lessley et al.

(10) Patent No.: US 9,718,083 B2
(45) Date of Patent: Aug. 1, 2017

(54) FLUID APPLICATION DEVICE HAVING A MODULAR NOZZLE ASSEMBLY FOR APPLYING FLUID TO AN ARTICLE

(71) Applicant: Illinois Tool Works Inc., Glenview, IL (US)

(72) Inventors: Mel Steven Lessley, Villa Hills, KY (US); Edward Wayne Bolyard, Jr., Old Hickory, TN (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 14/525,534

(22) Filed: Oct. 28, 2014

(65) Prior Publication Data

US 2015/0128853 A1 May 14, 2015

Related U.S. Application Data

(60) Provisional application No. 61/904,381, filed on Nov. 14, 2013.

(51) Int. Cl.
*B05B 13/02* (2006.01)
*B05C 5/00* (2006.01)
*B05C 5/02* (2006.01)

(52) U.S. Cl.
CPC ..... *B05C 5/0245* (2013.01); *B05C 5/0241* (2013.01); *B05C 5/027* (2013.01)

(58) Field of Classification Search
USPC ..... 118/300, 325, 313–315, 410, 411, 413
See application file for complete search history.

(56) References Cited

U.S. PATENT DOCUMENTS 3,529,571 A 9/1970 Good et al.
3,997,128 A 12/1976 Hara et al.
(Continued)

FOREIGN PATENT DOCUMENTS

CN 201295663 Y 8/2009
CN 101557883 A 10/2009
(Continued)

OTHER PUBLICATIONS

International Search Report for PCT/US2014/065246 dated Feb. 5, 2015.
(Continued)

*Primary Examiner* — Yewebdar Tadesse
(74) *Attorney, Agent, or Firm* — Levenfeld Pearlstein, LLC

(57) ABSTRACT

A fluid application device having a modular nozzle assembly is provided. The fluid application device includes an applicator head and a modular nozzle assembly fluidly coupled thereto. The modular nozzle assembly includes at least one guide slot configured to receive a strand of material, at least one orifice configured to discharge a first fluid onto a respective strand of material, and at least one securing opening extending through the modular nozzle assembly. Each securing opening is configured to receive a releasable securing element. The modular nozzle assembly may be a contact nozzle assembly or a non-contact nozzle assembly, and include fluid or air assist for altering a flow of the first fluid. The modular nozzle assembly may be selectively removed from and secured to the fluid application device so that the modular nozzle assembly may be selectively switched between the contact nozzle assembly and the non-contact nozzle assembly.

6 Claims, 4 Drawing Sheets

(56) References Cited

U.S. PATENT DOCUMENTS

| | | | | |
|---|---|---|---|---|
| 5,289,767 | A | 3/1994 | Montalto et al. | |
| 5,389,151 | A * | 2/1995 | Fort | B05C 5/027 118/411 |
| 6,001,178 | A * | 12/1999 | Borgmann | B05C 5/0241 118/410 |
| 6,361,634 | B1 | 3/2002 | White et al. | |
| 6,368,409 | B1 | 4/2002 | Borsuk et al. | |
| 6,540,831 | B1 | 4/2003 | Craine et al. | |
| 6,619,566 | B2 | 9/2003 | Gressett et al. | |
| 7,934,465 | B1 | 5/2011 | Brinker | |
| 8,033,243 | B2 | 10/2011 | Bolyard et al. | |
| 2002/0136833 | A1 | 9/2002 | Riney | |
| 2004/0164180 | A1 | 8/2004 | Harris et al. | |
| 2005/0274318 | A1 | 12/2005 | Bolyard et al. | |
| 2009/0000545 | A1 | 1/2009 | Bolyard et al. | |
| 2010/0024987 | A1 | 2/2010 | Saine et al. | |
| 2010/0025514 | A1 | 2/2010 | Kipping et al. | |
| 2012/0258246 | A1 | 10/2012 | Saine et al. | |

FOREIGN PATENT DOCUMENTS

| | | | |
|---|---|---|---|
| CN | 101678990 | A | 3/2010 |
| EP | 1176232 | A1 | 1/2002 |
| EP | 1243347 | A2 | 9/2002 |
| EP | 2025412 | A1 | 2/2009 |

OTHER PUBLICATIONS

International Search Report for PCT/US2014/065250 dated Feb. 5, 2015.

International Search Report for PCT/US2014/065484 dated Mar. 19, 2015.

* cited by examiner

FLUID APPLICATION DEVICE HAVING A MODULAR NOZZLE ASSEMBLY FOR APPLYING FLUID TO AN ARTICLE

BACKGROUND

The following description relates to a fluid application device having a modular nozzle for applying a fluid to an article, and in particular, a fluid application device that includes a modular nozzle assembly that may be selectively removed from and secured to the fluid application device to allow for interchangeability of the modular nozzle assembly on a fluid application device.

Nonwoven fabrics are engineering fabrics that provide specific functions such as absorbency, liquid repellence, resilience, stretch, softness, strength, flame retardant protection, easy cleaning, cushioning, filtering, use as a bacterial barrier and sterility. In combination with other materials, the nonwoven materials can provide a spectrum of products with diverse properties and can be used alone or as components of hygiene apparel, home furnishings, health care, engineering, industrial and consumer goods.

A plurality of elasticated strands may be positioned on and bonded to the nonwoven materials to, for example, allow for flexibility fitting around an object or a person. The strands may be bonded to the nonwoven fabric with an adhesive, such as glue or glue fiber. In one configuration, the strands are fed past a nozzle on an adhesive application device. The nozzle may include a plurality of openings through which the glue or glue fiber may be discharged. In some nozzles, a second fluid, such as air, may be discharged through separate outlets to control the application of the glue fiber such that the glue fiber is vacillated across the respective strands as the strands pass by the nozzle.

An adhesive application device may apply adhesive to the strands with either a contact nozzle or a non-contact nozzle. A contact nozzle discharges a volume of glue, which is substantially stationary, on to a substrate, such as a strand of material, as the strand of material is fed by the glue. The strand is in contact with the glue as the strand is fed by, and the glue adheres to the strand as a result of the contact. In a non-contact nozzle, the glue may be discharged from an outlet, for example, as a fiber. The glue is discharged over a gap between the outlet and the strand, and is ultimately received on the strand. Discharging of the glue fiber may be controlled by a second fluid, such as air, discharged from adjacent outlets, to vacillate the glue fiber during application on the strand.

Different types of nozzles, i.e., the contact nozzle or the non-contact nozzle, may be desirable depending on a specific application. However, different adhesive application devices are currently used to provide the different nozzles. That is, an adhesive application device outfitted with a non-contact nozzle for use in non-contact applications may not be easily modified to be outfitted with a contact nozzle to be used in contact applications or vice versa. Thus, multiple adhesive application devices are currently used to provide the different strand coating characteristics associated with contact and non-contact nozzles. As such, heavy costs may be incurred due to the additional equipment.

Accordingly, it is desirable to provide a fluid application device having a modular nozzle assembly that may be easily and selectively removed and replaced with a same or different type of nozzle assembly to provide different application characteristics with a single fluid application device.

SUMMARY

According to one embodiment, there is provided a fluid application device having an applicator head and a modular nozzle assembly fluidly coupled to the applicator head. The modular nozzle assembly includes at least one guide slot configured to receive a strand of material, at least one orifice configured to discharge a first fluid onto a respective strand of material, and at least one securing opening extending through the modular nozzle assembly. Each securing opening is configured to receive a securing element. The modular nozzle assembly is releasably secured to the fluid application device by way of the securing element received by each securing opening. The modular nozzle assembly is one of a modular contact nozzle assembly and a modular non-contact nozzle assembly, and the one of the modular contact nozzle assembly and the modular non-contact nozzle assembly is interchangeably securable to the applicator head with the other. For example, the modular nozzle assembly may be a non-contact nozzle, a contact nozzle with fluid or air assist causing a variation in the flow and application of the first fluid onto the strand, and a contact nozzle without fluid or air assist. The different modular nozzle assemblies may be interchangeably used with the fluid application device. Accordingly, the fluid application device may be converted between a non-contact-type fluid application device having a non-contact nozzle, a contact-type fluid application device having a contact nozzle with fluid or air assist to alter or vary the flow of the first fluid during application to the strand, and a contact-type fluid application device having a contact nozzle without fluid or air assist.

According to another embodiment there is provided a modular nozzle assembly for a fluid application device. The modular nozzle assembly includes at least one guide slot configured to receive a strand of material, at least one orifice configured to discharge a first fluid onto a respective strand of material, and at least one securing opening extending through the modular nozzle assembly. Each securing opening is configured to receive a securing element.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
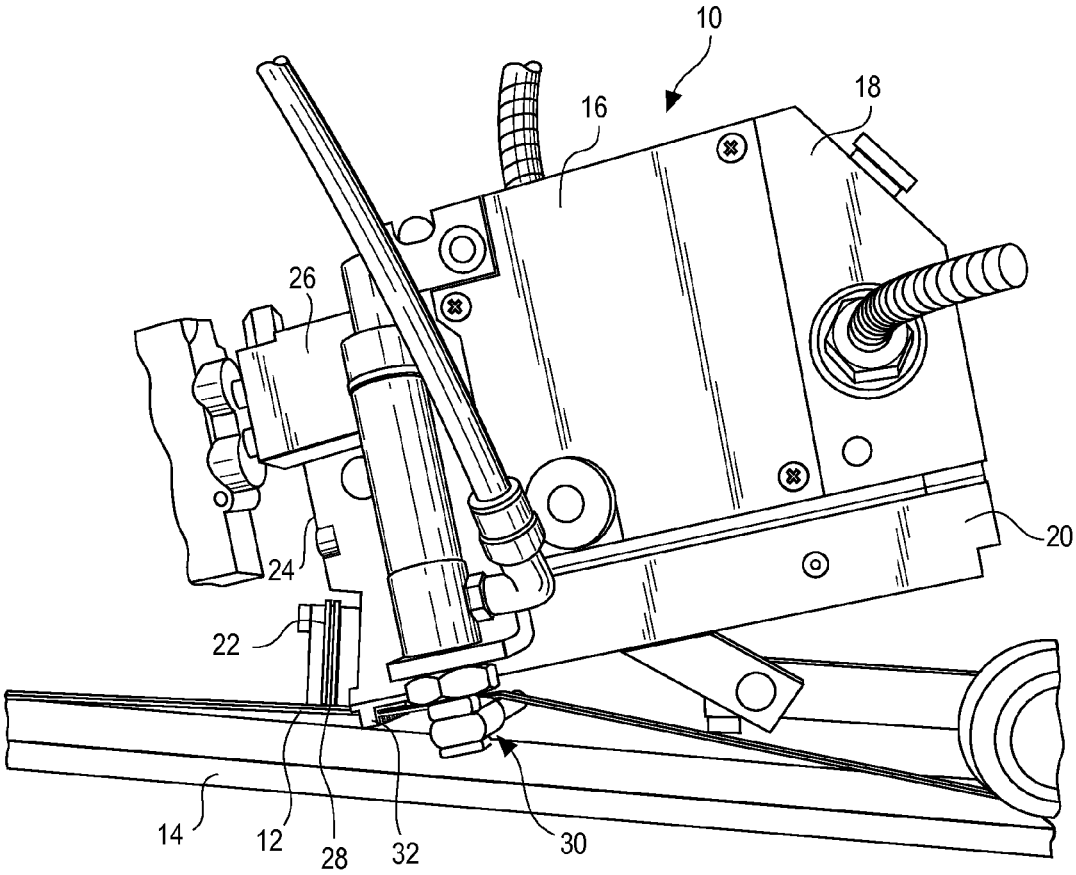
FIG. 1 is a perspective view of a fluid application device having a modular nozzle assembly according to an embodiment described herein.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

FIG. 1 is a perspective view of a fluid application device 10 according to an embodiment described herein. The fluid application device 10 may be used to apply a fluid on an article being fed by the device 10 using a modular nozzle assembly to discharge the fluid. The modular nozzle assembly may be a modular non-contact nozzle assembly or a modular contact nozzle assembly, with or without oscillating capabilities, as described further below. The fluid application device 10 may apply a first fluid on an article. The first fluid may be a viscous fluid that is a liquefied material heated or non-heated between 10 and 50,000 centipoise (cps). The first fluid may be, for example, an adhesive, and the article may be, for example, a strand 12 of material. That is, in one embodiment, the fluid application device 10 is part of a strand coating system. The adhesive may be applied to the strand 12 to adhere the strand 12 to a substrate 14, such as a nonwoven material. The strand 12 may be made from an elastic or non-elastic material and may be in either a stretched condition or a relaxed condition as the first fluid is applied. The strand 12 of material may be, for example, spandex, rubber or other similar elastic material.

According to one embodiment, the fluid application device 10 includes an applicator head 16. The applicator head 16 may include a first fluid supply unit 18, a second fluid supply unit 20 and a modular nozzle assembly 22. The modular nozzle assembly 22 may be, for example, a modular non-contact nozzle assembly 22. The first fluid supply unit 18 is configured to receive the first fluid from a first fluid source (not shown) and the second fluid supply unit 20 is configured to receive a second fluid from a second fluid source (not shown). The modular nozzle assembly 22 is fluidly coupled to, i.e., is in fluid communication with, the first fluid supply unit 18. The modular nozzle assembly 22 may also be fluidly coupled to, i.e., may be in fluid communication with, the second fluid supply unit 20. Accordingly, the modular nozzle assembly 22 may receive the first fluid from the first fluid supply unit 18 and the second fluid from the second fluid supply unit 20.

In some embodiments, the applicator head 16 may also include an adapter 24 secured to at least one of the first fluid supply unit 18 and second fluid supply unit 20. The adapter 24 is positioned adjacent to the modular nozzle assembly 22 and is fluidly coupled to, i.e., is in fluid communication with, the modular nozzle assembly 22. In addition, the adapter 24 is fluidly coupled to one of or both of the first fluid supply unit 18 and second fluid supply unit 20, such that the modular nozzle assembly 22 may receive the first fluid and the second fluid via the adapter 24. That is, the adapter 24 is in fluid communication with one or both of the first fluid supply unit 18 and the second fluid supply unit 20 and also the modular nozzle assembly 22. The adapter 24 is configured to have the modular nozzle assembly 22 secured thereto such that the modular nozzle assembly 22 may be properly positioned and oriented relative to the strands 12 and applicator head 16 for application of the first fluid onto the strands 12.

The applicator head 16 may also include a flow control module 26. The flow control module 26 may include a valve or series of valves to regulate a flow of the first fluid and second fluid from the first fluid supply unit 18 and second fluid supply unit 20, respectively, to the modular nozzle assembly 22. In some embodiments, the adapter 24 and flow control module 26 are implemented as the same unit. This unit provides an adhesive path between one of or both of the first and second fluid supply units 18, 20 and the nozzle assembly 22. This unit, i.e., the combined adapter 24 and flow control module 26 may also include valving to start and stop the flow of adhesive.

With further reference to FIG. 1, the modular nozzle assembly 22 may be secured to the applicator head 16, adapter 24 or other adjacent component of the applicator head 16. As noted above, the modular nozzle assembly 22 may be formed as a modular non-contact nozzle assembly 22. In the modular non-contact nozzle assembly 22, the first fluid is discharged from an orifice 28 over a gap to be received on the strand 12. That is, in the non-contact nozzle application, the nozzle is spaced from the strand 12 during the fluid application process.

The modular nozzle assembly 22 includes at least one orifice 28. There may be at least one orifice 28 associated with each strand 12 of material. That is, each orifice 28 may discharge the first fluid on to a respective strand 12. Each orifice 28 may have a width of approximately 0.016-0.020 inches (in.), but is not limited thereto. For example, the width of the orifices 28 may be varied to accommodate different sizes of strands 12. In addition, in the non-contact nozzle, the second fluid may be discharged from at least one outlet adjacent to respective orifices 28 of the modular nozzle assembly 22. The second fluid may be used to control the application of, or otherwise act on the first fluid to vary a discharge path of the first fluid during application onto the strand 12. For example, the second fluid may oscillate the first fluid as it is applied. Accordingly, the first fluid may be applied on the strand 12 in a desired pattern.

The first fluid may be an adhesive, such as a hot melt adhesive. The adhesive may be discharged from the orifice 28 as a filament or fiber to be applied on the strand 12. The first fluid may be discharged from the orifice 28 as a substantially continuous filament or fiber, but may be intermittently discontinuous so long as the first fluid is sufficiently applied to the strand 12 to allow the strand 12 to satisfactorily bond to the substrate 14. In some embodiments, the second fluid causes a discontinuous application of the first fluid onto the strand 12. The applicator head 16 may be heated to either melt the first fluid or maintain the first fluid in a melted condition. For example, the first fluid supply unit 18, the second fluid supply unit 20, and/or the modular nozzle assembly 22 may be heated, and thus, may also radiate heat outwardly. The applicator head 16 may also include a heater.

The second fluid may be, for example, air, and may be used to control or otherwise affect the discharge of the first fluid from the orifice 28 of the modular nozzle assembly 22 onto the strand 12 as described above. In one embodiment, there are at least two outlets configured to discharge the second fluid adjacent to each orifice 28 that discharges the first fluid. It is understood, however, that the number of outlets associated with each orifice 28 may vary. For example, there may from one to six outlets associated with each orifice 28. The second fluid may be alternately discharged from the outlets adjacent to each orifice 28 to cause the first fluid to oscillate and be applied to the strand 12 in the desired pattern. In one embodiment, the first fluid may be applied to the strand 12 in a substantially sinusoidal pattern. However, the present disclosure is not limited to this application pattern. For example, the first fluid may be vacillated or oscillated by the second fluid such that the first fluid is applied in, for example, a repeated, non-repeated, irregular and/or asymmetrical pattern or patterns.

Figure 2:
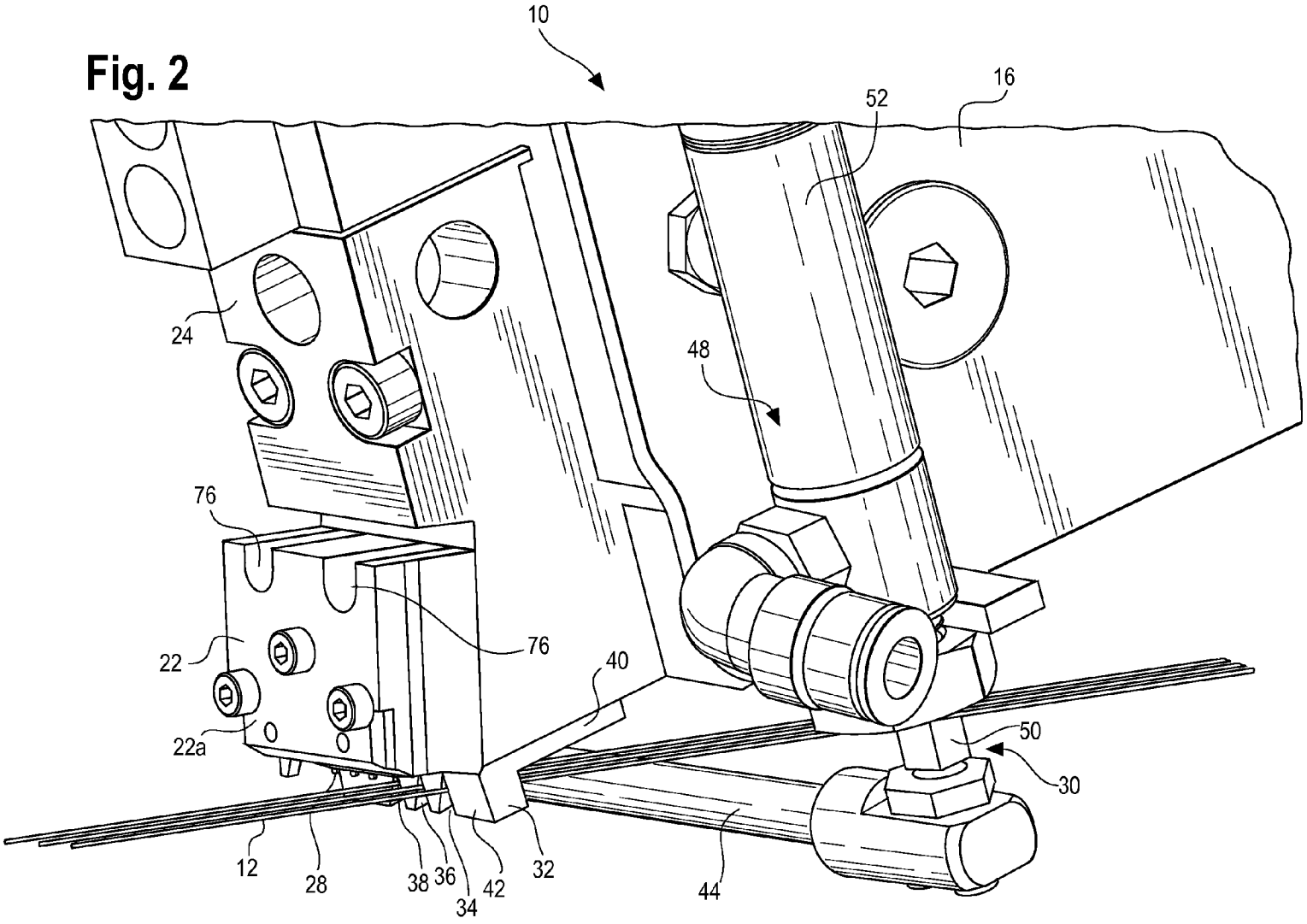
FIG. 2 is a perspective view of the fluid application device of FIG. 1 with an example of a modular non-contact nozzle assembly according to an embodiment described herein.

FIG. 2 is a perspective view of the fluid application device 10. Referring to FIGS. 1 and 2, the fluid application device 10 further includes a strand engagement device 30. The strand engagement device 30 may be formed integrally with, or operably connected to, the applicator head 16. Alternatively, the strand engagement device 30 may be secured to the applicator head 16 or other component of the fluid application device 10 with a suitable fastener, including, but not limited to, bolts, screws, rivets, adhesives, welds and the like. The strand engagement device 30 is configured to engage the strands 12 and move the strands 12 toward or away from the applicator head 16 and modular nozzle assembly 22 based on a line condition (active or static) of the fluid application device 10, as discussed further below.

Referring still to FIGS. 1 and 2, the non-contact modular nozzle assembly 22 may include a guide plate 32 to assist in positioning of the strands 12 relative to the orifices 28 and outlets of the modular nozzle assembly 22. The guide plate 32 includes at least one guide slot 34 through which the strand 12 may be fed. The guide slot 34 may be formed in a substantially inverted v-shape, with an open end 36 of guide slot 34 corresponding to a wide portion of the inverted v-shape, and a closed end 38 of the guide slot correspond to a narrow portion of the inverted v-shape. The closed end 38 may act as a limit or stop for the strand 12 to position the strand 12 at the desired position relative to the orifice 28 and outlets for application of the first fluid. That is, the closed end 38 may act as a stop to position the strand 12 a predetermined distance from the orifice 28. The strand 12 may either contact the closed end 38 or be positioned in close proximity to the closed end 38. The predetermined distance between the strand 12 and orifice 28 is a distance or gap where overspray may be reduced or minimized. In a direction of travel of the strands 12, the at least one guide slot 34 may be positioned before the orifices 28 of the modular nozzle assembly 22.

According to one embodiment, the at least one guide slot 34 may include three guide slots 34. However, it is understood that the number of guide slots 34 may vary, and is not limited to the example above. Each guide slot 34 is associated with a corresponding orifice 28 of the modular nozzle assembly 22. That is, each guide slot 34 may be substantially aligned with a corresponding orifice 28 of the modular nozzle assembly 22. For example, the closed end 38 of respective guide slots 34 may be aligned with respective orifices 28 in the direction of travel of the strands 12. Each guide slot 34 is configured to receive a separate strand 12, although it envisioned that more than one strand 12 may be received in each guide slot 34.

In one embodiment, the modular nozzle assembly 22 includes a body portion 22*a* and the guide plate 32 is formed separately from the body portion 22*a*. The guide plate 32 may be formed by a first flange 40 secured to the adapter 24 and a second flange 42 depending from the first flange 40. The at least one guide slot 34 may be formed in the second flange 42. The guide plate 32 may be secured to the adapter 24 using known releasable fastening techniques that do not interfere with the strands 12. For example, the guide plate 32 may secured to the adapter 24 or other adjacent portion of the applicator head 16 with bolts, screws, or other threaded fasteners, releasable adhesives, mating dovetails, snap or friction fit, and similar suitable fastening techniques or combinations thereof. The adapter 24 or other adjacent component of the applicator head 16 may include corresponding or mating fastener component so that the guide plate 32 may be releasably secured thereto. Accordingly, the guide plate 32 may be removed for servicing or replacement independent of the modular nozzle assembly 22. Alternatively, the guide plate 32 may be formed integrally with the body portion 22*a* of the modular nozzle assembly 22. For example, the guide plate 32 may include a flange that depends from the body portion 22*a* in which the guide slots 34 are formed.

With further reference to FIG. 2, the strand engagement device 30 includes an engagement arm 44 configured to support and/or guide the strand or strands 12. The engagement arm 44 is adjustable to move the strands 12 into and/or within respective guide slots 34 to accurately position the strands 12 relative to the respective orifices 28 and outlets so that the strands 12 are aligned with respective orifices 28 and held at a desired distance, i.e., at a desired gap, from the orifices 28.

Figure 3:
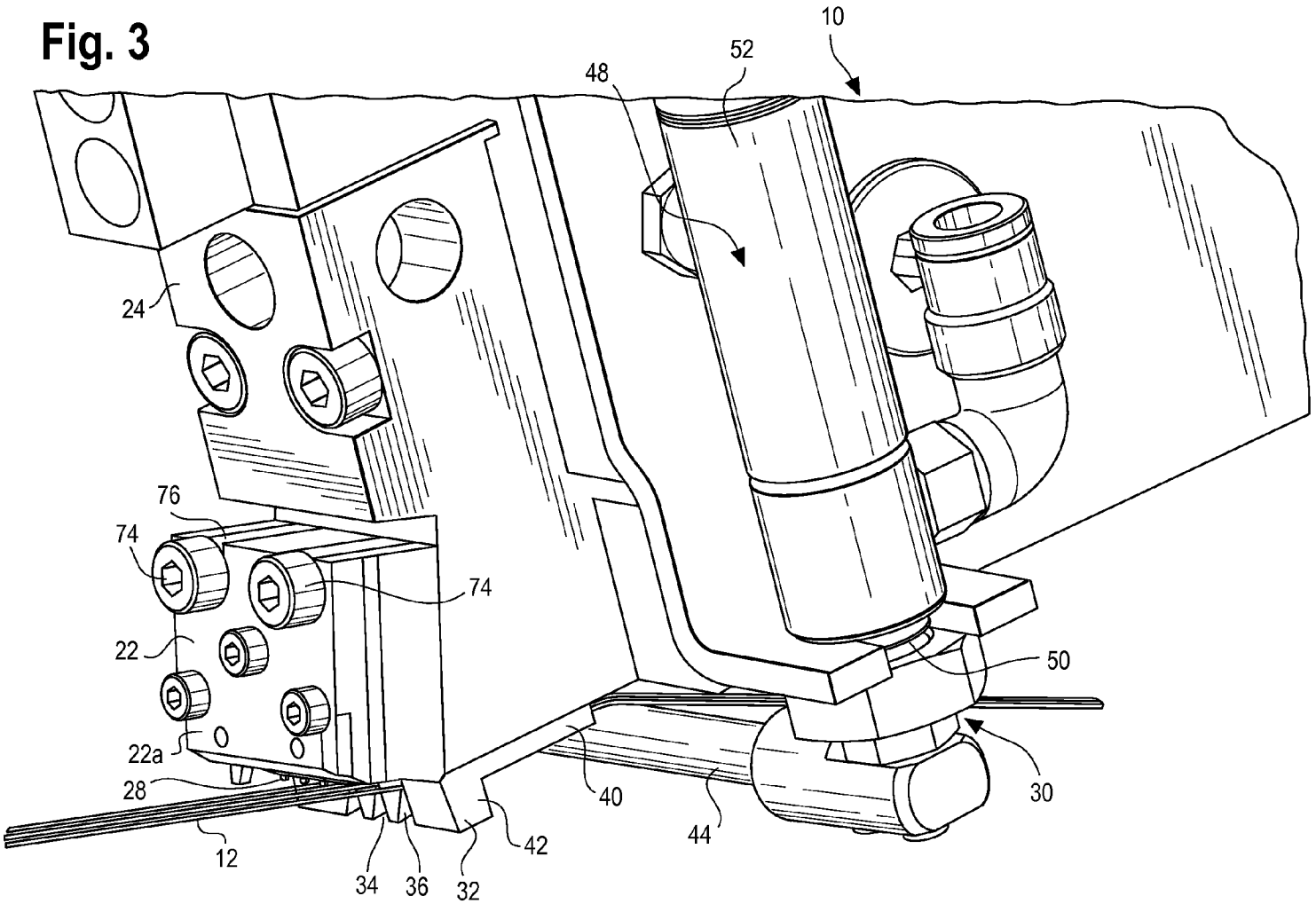
FIG. 3 is another perspective view of the fluid application device of FIGS. 1 and 2 with the exemplary modular non-contact nozzle assembly according to an embodiment described herein.

FIG. 2 shows the engagement arm 44 in a first position. FIG. 3 is a perspective view of the fluid application device 10 with the engagement arm 44 in a second position. That is, the engagement arm 44 is adjustable between a first position, as shown in FIG. 2, and a second position, as shown in FIG. 3. The first position corresponds to a position where the engagement arm 44 is spaced a first distance from the applicator head 16. The first distance is sufficient to prevent or limit damage, such as burn through, to the strands 12 caused from heat radiating from the applicator head 16 and/or modular nozzle assembly 22. For example, the engagement arm 44, in the first position may hold the strands 12 approximately 3-5 mm from an orifice 28 and/or a heat source of the applicator head 16. Moving the engagement arm 44 to, and maintaining the engagement arm 44 in, the first position may be beneficial when the fluid application device 10 is in a static line condition, where the strands 12 are not being fed past the modular nozzle assembly 22.

The second position corresponds to a position where the engagement arm 44 is spaced a second distance, less than the first distance, from the applicator head 16 or orifices 28, such that the strands 12 are moved closer to the applicator head 16 and the respective orifices 28. In one example, the second position of the engagement arm 44 positions the strands approximately 1-3 mm from the orifices 28 of the modular nozzle assembly 22, and more preferably, 1-2 mm. That is, the second position of the engagement arm 44 generally corresponds to the gap over which the first fluid is to be applied on the strand 12. Moving the engagement arm 44 to, and maintaining the engagement arm in, the second position may be beneficial when the fluid application device 10 is in an active line condition, so that the first fluid may be efficiently applied on the strands 12. For example, overspray of the first fluid onto the strands 12 may be reduced with the engagement arm 44 in the second position compared to the first position.

Referring still to FIGS. 2 and 3, the engagement arm 44 may be adjusted by an actuating assembly 48. The actuating assembly 48 may be, for example, a pneumatically controlled piston 50 and cylinder 52. For example, the piston 50 may be movable with in a cylinder 52 in response to air or another gas being introduced into the cylinder 52. The piston 50 may be connected directly or indirectly to the engagement arm 44 such that movement of the piston 50 in and out of the cylinder 52 causes the engagement arm 44 to move toward or away from the applicator head 16. Although the embodiments above refer to an actuating assembly comprising pneumatically controlled piston and cylinder, it is understood that other actuating assemblies are envisioned as well. For example, the actuating assembly may be a direct-controlled solenoid that may be configured for selective reciprocating movement.

The modular nozzle assembly 22 may be formed as a modular unit. That is, the modular nozzle assembly 22 may be selectively removed from and secured to the fluid application device 10. Accordingly, the modular nozzle assembly 22 may be replaced in the event a newer or different nozzle is desired or required. The modular nozzle assembly 22 may be selectively removable from and securable to the fluid application device 10 by way of at least one securing element 74. In one embodiment, the modular nozzle assembly 22 includes at least one securing opening 76 extending therethrough. Each securing opening 76 is configured to receive a respective securing element 74. For example, referring to FIGS. 2 and 3, the modular nozzle assembly 22 may include two securing openings 76, each configured to receive a respective securing element 74.

It is understood that the number of securing openings 76 is not limited to the example above, however. Individual securing openings 76 may be formed as an opening or slot extending through the modular nozzle assembly 22. The opening or slot may be closed about its periphery or include an open side along an edge of the modular nozzle assembly 22. The securing elements 74 extend through the securing openings 76 and are received in corresponding bores (not shown) in the fluid application device 10. The corresponding bores are aligned with the securing openings to receive the securing elements so that the modular nozzle assembly 22 may be secured to the applicator head 16. In one embodiment, the corresponding bores (not shown) may be formed in the adapter 24 and the modular nozzle assembly 22 is secured to the adapter 24.

The securing elements 74 may be releaseable securing elements, for example, bolts, screws or similar threaded fasteners, but are not limited thereto. For example, the securing elements 74 may include cam-actuated fasteners, positive locking fasteners or two-part fasteners having a separate retention mechanism. Dovetail, snap-fit, friction-fit and other similar securing elements 74 may be suitable in some examples as well. The securing elements 74 may be rotationally actuated to apply a clamping force to the modular nozzle assembly 22 such that the modular nozzle assembly 22 is clamped between one end of the respective securing elements 74 and the adapter 24 or other adjacent component of the fluid application device 10.

Similarly, the guide plate 32 may be releasably secured to the adapter 24 or other adjacent component of the applicator head 16. Accordingly, the guide plate 32 may be selectively secured to and removed from the adapter 24 or other adjacent component of the applicator head 16.

The securing elements 74 may be operated to apply or release a clamping force or other securing force to, or from, the modular nozzle assembly 22. Accordingly, the modular nozzle assembly 22 may be selectively secured to or removed from the applicator head 12. Thus, the modular nozzle assembly 22 may be replaced without modification to the fluid application device 10.

Figure 4:
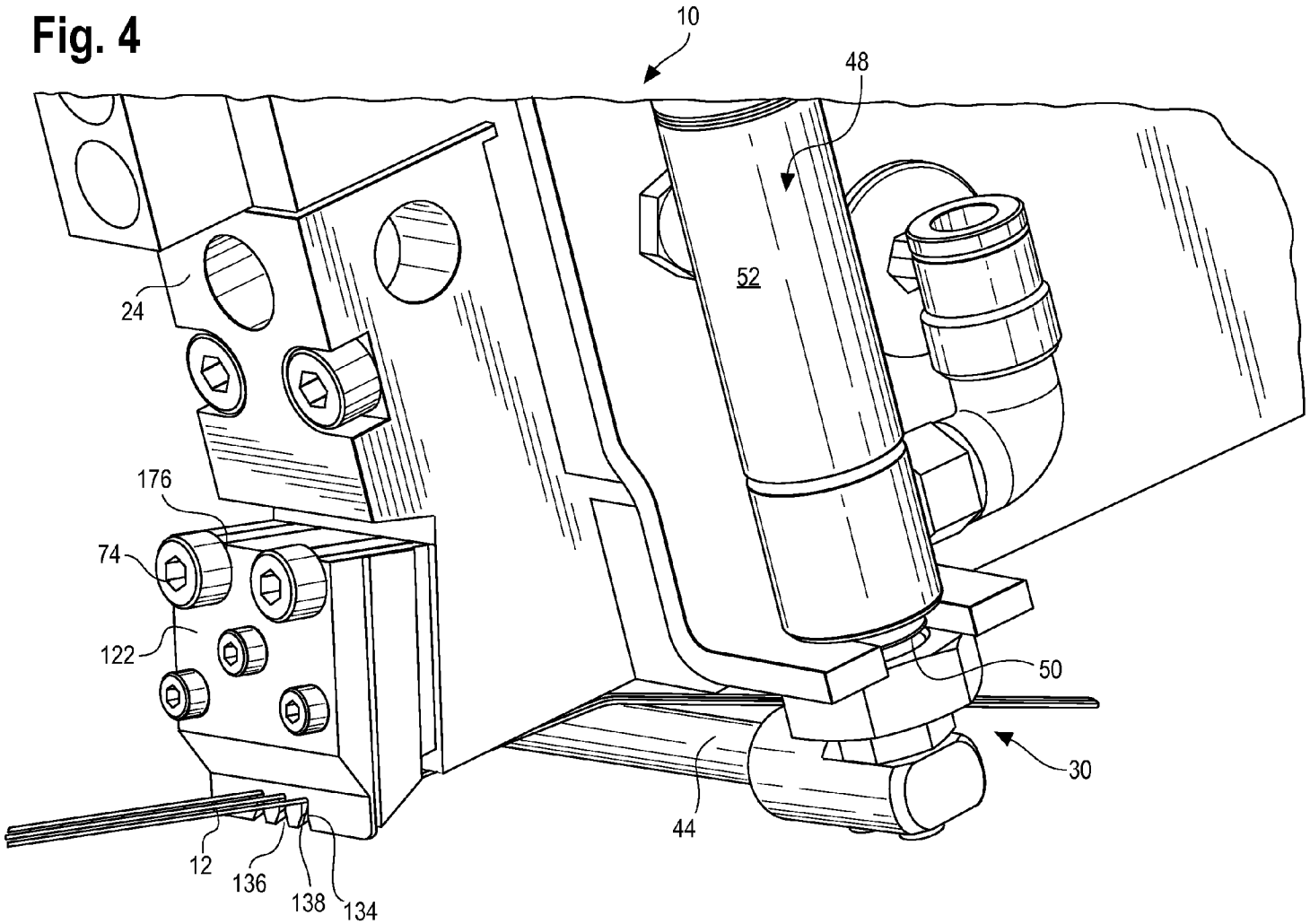
FIG. 4 is a perspective view of a fluid application device with an exemplary modular contact nozzle assembly according to an embodiment described herein.

FIG. 4 is a perspective view of a fluid application device with another example of a modular nozzle assembly according to an embodiment described herein. Referring to FIG. 4, and as noted above, the modular nozzle assembly may alternatively be a modular contact nozzle assembly 122. It is understood that features in shown in the example in FIG. 4 that are similar or common to features shown in the examples in FIG. 1-3 may be referred to with the same reference numbers and/or terminology as used above, and further description of features above may be omitted below.

The modular contact nozzle assembly 122 may be formed as, for example, a modular fluidic oscillator contact nozzle. The modular fluidic oscillator contact nozzle assembly 122 includes at least one orifice 128 and at least one guide slot 134 corresponding to each orifice 128. Each guide slot 134 includes an open end 136 and a closed end 138. The open end 136 may include an inverted v-shaped portion to assist in receiving the strand 12 in the guide slot 134. The guide slots 134 may have a substantially constant width between the inverted v-shape at the open end 136 and the closed end 138.

The closed end 138 is adjacent to the orifice 128 and serves to position the strand 12 immediately adjacent to, or at least partially within the orifice 128. The first fluid is provided to at least one internal reservoir (not shown) in fluid communication with each orifice 128. The closed end 138 may be shaped or contoured to match the profile of the strand 12. For example, the closed end 138 may be formed as an arc matching a portion of the cross-sectional profile of the strand 12. In some examples, each orifice 128 is in fluid communication with a corresponding internal reservoir. The first fluid, for example, a viscous adhesive, is received in the orifice 128 from the internal reservoir and may remain positioned in the orifice 128 or protrude from the orifice 128 into the guide slot 134 in the form of a bead.

Each orifice 128 may be in fluid communication with at least one internal conduit (not shown). For example, in one embodiment, each orifice 128 may be in fluid communication with two conduits, positioned on generally opposite sides of the orifice 128. Each conduit may supply the second fluid to the orifice 128 at varying pressures, thereby causing the first fluid to oscillate during application to the strand 12. Alternatively, the conduits may supply an additional quantity of the first fluid to the orifice at varying pressures, causing the first fluid to oscillate during application to the strand 12 as well. In one embodiment, the first fluid is irregularly oscillated during application on the strand 12.

A strand 12 of material may be positioned in the guide slot 134 at the closed end 138. The strand 12 is fed through guide slot 134 and comes into contact with the first fluid in the orifice 128 or the bead of first fluid protruding into the guide slot 134. The first fluid adheres to the strand 12 as the strand 12 is fed by. That is, in the modular contact nozzle assembly 122, the first fluid may be applied directly to the strand 12 instead of being discharged as a filament over a gap.

The modular contact nozzle assembly 122 includes at least one securing opening 176. Each securing opening 176 is configured to receive a respective securing element 74. It is understood that the securing openings 176 are similar to the securing openings 76 described in the examples above. That is, the securing openings 176 may be shaped, sized and positioned similarly to the securing opening 76 described in the examples above. It is understood, however, that some variance in the shape, size and position between the securing openings 76 and securing openings 176 may be permitted so long as the securing openings 76 and securing openings 176 align with the corresponding bores (not show) on the applicator head 16, so that the securing elements 74 may be received therein, as described above. It is also understood the securing elements 74 may vary between the embodiments above so long as the securing elements 74 may be received through the securing openings 76, 176 and the corresponding bores (not shown) to secure the modular nozzle assemblies 22, 122 to the applicator head 16 at the desired location and position.

Accordingly, the modular contact nozzle assembly 122 may be selectively secured to and removed from the applicator head 16. As such, the modular contact nozzle assembly 122 may be used interchangeably with the modular non-contact nozzle assembly 22 described above with reference to FIGS. 1-3, depending on the desired fluid application pattern and line speed, without modification to the fluid application device 10.

It is understood that the modular nozzle assemblies implemented with the fluid application device 10 are not limited only to the examples of the modular non-contact nozzle assembly 22 and modular contact nozzle assembly 122 described above. For example, the modular nozzle assembly may be a modular contact nozzle assembly that applies the first fluid to the strand 12 in a linear pattern. This type of contact nozzle assembly may be referred to as a linear bonding nozzle. In a linear bonding nozzle, the strand 12 is fed by an orifice from which the first fluid or adhesive is supplied, for example, as a bead. The first fluid adheres to the strand 12 is a substantially linear pattern.

Other contact and non-contact nozzle assemblies may be implemented as well. For example, nozzle assemblies including securing openings shaped, sized and positioned similarly to securing openings 76, 176 described in the embodiments above may be implemented with the fluid application device 10. That is, nozzle assemblies having securing openings that align with the corresponding bores of the adapter 24 or other portion of the applicator head 16 to receive the respective securing elements 74 so that the modular nozzle assembly may be selectively secured to and removed from the applicator head 16 may be used.

In operation, the fluid application device 10 may have either a modular non-contact nozzle assembly 22 or a modular contact nozzle assembly 122 secured thereto. In one example, the modular nozzle assembly 22, 122 may be secured to the adapter 24 or other adjacent component of the applicator head 16. With the modular non-contact nozzle assembly 22 secured to the applicator head 16, the strand 12 may extend over the engagement arm 44 and through the guide slot 34 for proper positioning relative to a respective orifice 28. The first fluid may be discharged from the orifice 28 as a filament or fiber, over a gap, and on to the strand 12. The first fluid may be oscillated during application on to the strand 12 by a second fluid discharged from outlets adjacent to the orifice 28.

The fluid application device 10 may be readily converted from a non-contact-type device, i.e, a fluid application device having non-contact nozzle assembly, to a contact-type device, i.e., a fluid application device having a contact nozzle assembly, by replacing the modular non-contact nozzle assembly 22 with the modular contact nozzle assembly 122. To remove the modular non-contact nozzle assembly 22, the at least one securing element 74 may be actuated so as to release the clamping or other securing force applied to the modular non-contact nozzle assembly 22. The modular non-contact nozzle assembly 22 may then be removed from the applicator head 16 of the fluid application device 10 and the securing elements 74 removed from the securing openings 76. The modular contact nozzle assembly 122 may then be installed on the fluid application device 10. The securing elements 74 may be inserted through the securing openings 176 of the modular contact nozzle assembly 122 and received in the corresponding bores (not shown) of the adapter 24 or other adjacent component of the applicator head 16. The securing elements 74 may be then actuated to apply the clamping or other securing force to the modular contact nozzle assembly 122. It is understood that any of the fluidic oscillator contact nozzle 122, the linear bonding nozzle, or other suitable contact or non-contact nozzle assembly may be interchangeably implemented with the fluid application device 10 in this manner.

The fluid application device 10 may be converted from the contact-type device to the non-contact-type device by a process similar to that described above. The securing elements 74 may be actuated to release the clamping force from the modular contact nozzle assembly 122. The modular contact nozzle assembly 122 may then be removed from the fluid application device 10 and the securing elements 74 removed from the securing openings 176. The modular non-contact nozzle assembly 22 may then be installed on the fluid application device 10. The securing elements 74 may be inserted through the securing openings 76 of the modular non-contact nozzle assembly 22 and be received in the corresponding bores (not shown) of the adapter 24 or other adjacent component of the applicator head 16. The securing elements 74 may be then actuated to apply the clamping or other securing force to the modular non-contact nozzle assembly 22. That is, different nozzle assemblies (e.g, non-contact nozzle assembly with fluid or air assist, contact nozzle assembly with fluid or air assist, contact nozzle assembly without fluid or air assist) may be interchangeably used with the fluid application device 10. Accordingly, the fluid application device 10 may be converted between, for example, a contact-type device having a modular contact nozzle assembly with no fluid or air assist or oscillator (e.g., linear bonding nozzle), a contact-type device having a modular contact nozzle assembly with fluid or air assist (e.g., fluidic oscillator contact nozzle), and a non-contact device with air or fluid assist having a modular non-contact nozzle assembly.

In the embodiments above, a fluid application device may be converted from a non-contact type device to a contact type device, and vice versa, by replacing the modular nozzle assembly with a corresponding type of nozzle. Similarly, different contact and non-contact nozzle assemblies may be used with a single fluid application device 10. Accordingly, different application patterns of the first fluid may be applied to the article as desired. By using the modular nozzle assembly 22, 122 as described above, use of additional or different fluid application devices for different fluid application patterns may be avoided. In the above embodiments, end users may run line speeds at an increased speed with improved efficiency while reducing or eliminating overspray of a fluid, such as an adhesive, with the non-contact type nozzle. The end user may easily switch between a non-contact type application and a contact type application be replacing the modular non-contact nozzle assembly with the modular contact nozzle assembly on the same fluid application device. A contact type application may allow for higher line speeds, compared to some traditional non-contact configurations.

The strands 12, coated with the first fluid, may be applied and adhered to the substrate 14, i.e., the nonwoven material or film. The nonwoven material may be used in, for example, manufacture of baby diapers and pull-on products, adult incontinence products, feminine hygienic products, medical/hospital pads, light incontinence products, wipes or other nonwoven or film laminated articles used in a hygienic end product.

It is understood that in the various embodiments and/or examples described above, similar features are referred to using similar terminology and reference numbers. It is further understood that various features of one embodiment or example may be incorporated into the other embodiments or examples.

It should also be understood that various changes and modifications to the presently disclosed embodiments will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A fluid application device, comprising:

an applicator head; and a modular nozzle assembly fluidly coupled to the applicator head, the modular nozzle assembly comprising:

at least one guide slot configured to receive a strand of material;

at least one orifice configured to discharge a first fluid onto a respective strand of material; and at least one securing opening extending through the modular nozzle assembly, each securing opening configured to receive a releasable securing element;

wherein, the modular nozzle assembly comprises a modular contact nozzle assembly and a modular non-contact nozzle assembly, and the modular contact nozzle assembly and the modular non-contact nozzle assembly are interchangeably securable to the applicator head with the other to provide:

a first state where only the modular non-contact nozzle assembly of the modular nozzle assembly is secured to the applicator head, wherein the modular non-contact nozzle assembly includes a guide plate and the at least one guide slot is formed in the guide plate and wherein the at least one guide slot is spaced from the at least one orifice and is configured to position the strand so that the strand is spaced from the at least one orifice by a distance such that a fluid discharged from the at least one orifice is discharged across the distance onto the strand; and a second state where only the modular contact nozzle assembly of the modular nozzle assembly is secured to the applicator head, and the at least one guide slot is aligned with the at least one orifice and configured to position the strand immediately adjacent to, or partially within, the at least one orifice such that the fluid is discharged directly onto the strand.

2. The fluid application device of claim 1, wherein the at least one guide slot includes an open end and a closed end, wherein the closed end is configured to position the strand relative to the at least one orifice.

3. The fluid application device of claim 1, further comprising an adapter, wherein the modular nozzle assembly is releasably secured to the adapter with the at least one releasable securing element.

4. The fluid application device of claim 1, wherein, in the first state, the modular non-contact nozzle assembly includes a nozzle body, wherein the at least one orifice and at least one securing opening are formed in the nozzle body, and the guide plate is formed separately of the nozzle body and is releasably secured to the applicator head.

5. The fluid application device of claim 1, wherein, in the second state, the at least one guide slot includes three guide slots and the at least one orifice includes three orifices, each orifice associated with a respective guide slot.

6. The fluid application device of claim 1, wherein the releasable securing element includes at least one of a threaded fastener, a cam-actuated fastener, a positive locking fastener and a two-part fastener having a separate retention mechanism.

* * * * *